United States Patent [19]

Reusswig

[11] Patent Number: 4,486,125

[45] Date of Patent: Dec. 4, 1984

[54] MODULAR ARCTIC STRUCTURES SYSTEM

[75] Inventor: Gerhard H. Reusswig, Irving, Tex.

[73] Assignee: Mobil Oil Corporation, New York, N.Y.

[21] Appl. No.: 454,827

[22] Filed: Dec. 30, 1982

[51] Int. Cl.[3] ..... E02B 17/02; E02D 23/02

[52] U.S. Cl. ..... 405/217; 405/203; 405/204; 405/195

[58] Field of Search ..... 405/195, 217, 203–208, 405/61

[56] References Cited

U.S. PATENT DOCUMENTS

| | | | |
|---|---|---|---|
| 3,766,737 | 10/1973 | Howard | 405/61 |
| 3,881,318 | 5/1975 | Galloway | 405/212 |
| 3,952,527 | 4/1976 | Vinieratos et al. | 405/217 |
| 4,080,798 | 3/1978 | Reusswig et al. | 405/217 |
| 4,142,819 | 3/1979 | Challine et al. | 405/196 |
| 4,199,275 | 4/1980 | Tuson | 405/204 X |
| 4,230,423 | 10/1980 | Oshima et al. | 405/211 |
| 4,245,929 | 1/1981 | Pearce et al. | 405/217 X |
| 4,265,569 | 5/1981 | Gefvert | 405/217 |
| 4,314,776 | 2/1982 | Palmer et al. | 405/203 X |
| 4,335,980 | 6/1982 | DePriester | 405/217 |
| 4,360,291 | 11/1982 | Cranberg et al. | 405/205 |

*Primary Examiner*—Dennis L. Taylor

*Attorney, Agent, or Firm*—A. J. McKillop; M. G. Gilman; J. F. Powers, Jr.

[57] ABSTRACT

A modular and floatable offshore exploration and production platform system for use in shallow arctic waters is disclosed. A concrete base member is floated to the exploration or production site, and ballated into a predredged cavity. The cavity and base are sized to provide a stable horizontal base 30 feet below the mean water/ice plane. An exploration or production platform having a massive steel base is floated to the site and ballasted into position on the base. Together, the platform, base and ballast provide a massive gravity structure that is capable of resisting large ice and wave forces that impinge on the structure. The steel platform has a sloping hourglass profile to deflect horizontal ice loads vertically, and convert the horizontal load to a vertical tensile stress, which assists in breaking the ice as it advances toward the structure.

18 Claims, 14 Drawing Figures

MODULAR ARCTIC STRUCTURES SYSTEM

BACKGROUND OF THE INVENTION

1. Field of the Invention

The present invention relates to offshore modular and floatable gravity structures which are normally supported on the sea bed in shallow water and which, in deeper water include a steel gravity platform is supported by a concrete base resting on the ocean floor; with steel gravity structure being adapted to support an oil and/or gas exploration or production platform. More particularly, the invention is adapted for use in an arctic environment wherein the structural system is subjected to significant horizontal and tipping moments generated by impinging ice sheets, ice packs, and iceridges or floes.

2. Discussion of the Prior Art

Heretofore, a number of varied solutions to the problems encountered in protecting offshore oil and gas drilling structures from damage caused by ice sheets, ice packs, and iceridges or floes have been suggested in the prior art. This technology has developed as the offshore exploration and production of oil and gas has extended into arctic regions consisting of oceans, inlets and bays wherein the waters are frequently covered by vast sheets of ice during the winter months, and extremely large ice floes in the magnitudes ranging up to a mile across and even larger during and other seasons.

Pierce et al. U.S. Pat. No. 4,245,929 discloses an offshore structure which is able to withstand ice forces generated by impinging ice sheets, ice packs, or iceridges, and wherein the lower portion of the support structure of the offshore platform includes upper and lower differently sloped conical exterior wall portions to form an inclination relative to the horizontal. The inclined conical wall portions are designed to deflect ice masses coming into contact with the platform support structure. The particular structural selection of the conical wall structure is designed to cause the ice to tilt upwardly upon impinging against the support structure and fragment the ice by converting the horizontal load to vertical tensile stresses. In contrast therewith, the invention improves upon the structure disclosed in Pierce et al. in at least two major respects. Firstly, the inventive structure is modular and floatable to allow for repositioning of the structure when the system is used for exploratory oil and gas well drilling. Secondly, the structure is designed to generate extremely high gravitational shear forces which will withstand the horizontal and vertical forces normally generated by ice sheets and dense ice packs. Additionally, the gravity mass of the inventive structure is sufficient to withstand ocean waves of maximum amplitude for the depth of water in which the structure is intended to operate.

Howard U.S. Pat. No. 3,766,737 discloses an offshore platform which is encompassed, at a radial distance from the platform, by a circumferentially movable ice trenching machine. This machine circulates about the platform so as to fragment and remove ice in a circular path at a rate approximately equal to the rate of movement of the ice sheet.

Oshima et al. U.S. Pat. No. 4,230,423 discloses a rotary ice breaking member having spiral rotary blades attached to the main structure thereof for use in icy waters. The rotary blades raise the ice sheet or dense ice pack and cause it to shear or break in a flexural mode as the ice is raised.

Challine et al. U.S. Pat. No. 4,142,819 discloses an offshore platform in which the platform is of the gravity displacement type. This prior art structure includes a base member resting on the marine floor, and has an annular steel shell affording rigidity in the upwardly extending direction, and incorporates a circular wall and diaphragm extending about the base portion of the platform so as to constitute a reinforcement for the base structure. While Challine et al. disclose a portable drilling platform for use on the ocean floor, it is not particularly intended for use in the arctic environment, nor does it disclose any structure for protecting the device from the horizontal forces generated by sheet ice and dense ice packs.

Galloway U.S. Pat. No. 3,881,318 discloses a method and an apparatus for creating an artificial ice ridge to protect the work platforms from encroaching ice sheets, pressure ridges, ice floes and the like.

SUMMARY OF THE INVENTION

Accordingly, the present invention contemplates the provision of a novel modular arctic structural system for supporting an oil or gas exploration or drilling platform, and wherein the structure derives its stability and ability to resist large horizontal shear loads by virtue of a massive gravity base which is floated to the exploration or production cite and then submerged to the seabed through a unique and novel ballasting method.

The inventive structure is intended for use in relatively shallow waters; in effect, waters of about 20 to 100 ft in depth. The base structure is provided in a modular form, and is normally ballasted down into a predredged hole or cavity formed in the seabed to provide a support structure for the platform which is at a predetermined distance below the mean water level. As contemplated, the inventive base provides a stable support structure having an extremely high resistance to horizontal shear loads encountered 30 feet below the mean water plane. In addition, a platform arrangement for supporting an oil and/or gas exploration or drilling rig is equipped with a novel ice impacting structure capable of withstanding 1200 lbs/in$^2$ pressure over a relatively large circumferential area. Moreover, the outer periphery of the platform is heated and sloped so as to be able to convert any horizontal shear loads exerted by the ice into tensile stresses which will tend to fracture the ice rather than forming a resistance along the compression line of the ice sheet. As such, the lower base portion of the novel platform configuration concurrently serves as an ice deflector, an ice breaker and an ice shield.

The modular system of the present invention is designed to be reusable. Each component of the system is separately floatable and equipped with ballasting means for raising and lowering the structure to its gravity base position. Thus, a base may be fitted for an exploration site and an exploration platform floated in over the site and thereafter ballasted into position on the seabed. Upon completion of the exploration, if it is desired to provide a production platform for the oil or gas reserve discovered during the exploration process, the exploration platform may be deballasted and floated off the base, and a production platform floated in for oil or gas production. The base may remain in place, or if the oil and gas exploration data indicates the site is not economically viable for a production platform, the base may be refloated and moved to a new exploration site.

Thus, it is an object of the present invention to provide a floatable and reusable modular offshore exploration and production platform system which is particularly adapted for use in arctic environments, wherein the platform is subjected to large lateral shear forces from ice sheets, ice ridges, ice packs, ice floes and other ice formations. The present invention uses a floatable base member that is designed to be towed to an exploration or production site and which is equipped with novel ballasting means for lowering the base member below the water plane to a predredged ocean cavity. After it is ballasted with seawater or sand, the base member then defines a massive base structure for supporting an offshore exploration or production platform and provides a high lateral load resistance therefor. The system also comprises an offshore exploration or production platform wherein the platform itself is designed to be towed to an exploration or production site. The platform comprises a steel gravity structure having a conically or sloped surface at the mean water plane and a large massive base structure that cooperates with the first base member to define an ice deflector, an ice breaker and ice shield when used in an arctic environment. The platform also incorporates a ballasting arrangement for raising and lowering the platform from and onto the first base member. The base member defines a moon pool in the center thereof which is slightly larger in diameter than the moon pool furnished with the exploration or drilling platform wherein up to 20 holes may be drilled at each exploration or production site. After use, the platform and the base member may be separately reballasted at the end of the exploration or production cycle and refloated to a new exploration or production site.

It is another object of the present invention to provide a novel method for lowering a large massive concrete structure below the water plane while maintaining it in a stable lateral position. The method essentially comprises at least two steps, such as a first step of attaching a plurality of removable buoyancy caissons around the outer perimeter of the base; and secondly, filling a large interior annular cavity with sea water to define an interior lake level with the existing water plane and separated therefrom by a large annular rim surrounding the base member. The interior lake and the caissons provide the stability needed to prevent the structure from slipping sideways or tipping as it is lowered below the water plane by the ballasting means.

It is another object of the present invention to provide a high shear gripping means between the massive base member, and the exploration or drilling platform, by providing a sand bed therebetween, and in which the sand bed is confined by the annular rim extending upwardly around the perimeter of the base.

It is a further object of the present invention to provide a novel method of ensuring that the conical ice deflecting and breaking structure for the exploration and drilling platform is placed at its optimum operating level by predredging a cavity in the ocean floor, and using one or more of a plurality of modular bases to define a stable support base approximately thirty feet below the mean water plane.

Moreover, a still further object of the present invention is to provide a novel arrangement for pumping a sand slurry into one or more cavities defined between the ocean bottom and the base member so as to produce an ocean floor base interface which will present a high resistance to horizontal shear forces.

Yet another object of the present invention is to construct both an oil exploration platform and an oil production platform with an hourglass profile having a plurality of inclined or sloped surfaces thereon which will convert horizontal compressive forces exerted by the ice sheet into vertical shear forces so as to assist in breaking the ice into fragments as the horizontal shear load components are converted into vertical tensile forces.

It is a more specific object of the present invention to provide a structure as described which incorporates a heated ice deflector surface which will prevent adfreeze of the ice sheet during periods of the winter months when the ice sheet is relatively stationary.

BRIEF DESCRIPTION OF THE DRAWINGS

Reference may now be had to the following detailed description of preferred embodiments of the invention, taken in conjunction with the accompanying drawings; in which.

DETAILED DESCRIPTION OF THE PREFERRED EMBODIMENT

Figure 1:
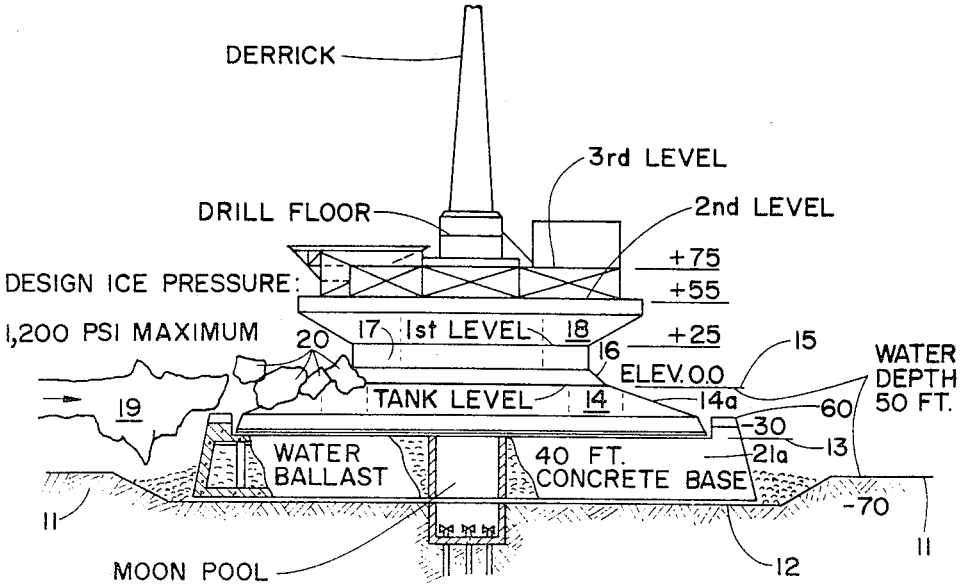
FIG. 1 is a partially sectioned plan view of an exploration platform and base member installed in an arctic environment in about 50 ft of water.

As illustrated in FIG. 1, the modular arctic structural system is installed in 50 ft of water in an arctic environment. The ocean floor 11 has been dredged 20 ft as indicated at 12 to provide a mean support level 13, 30 ft below the mean water plane.

Figure 2:
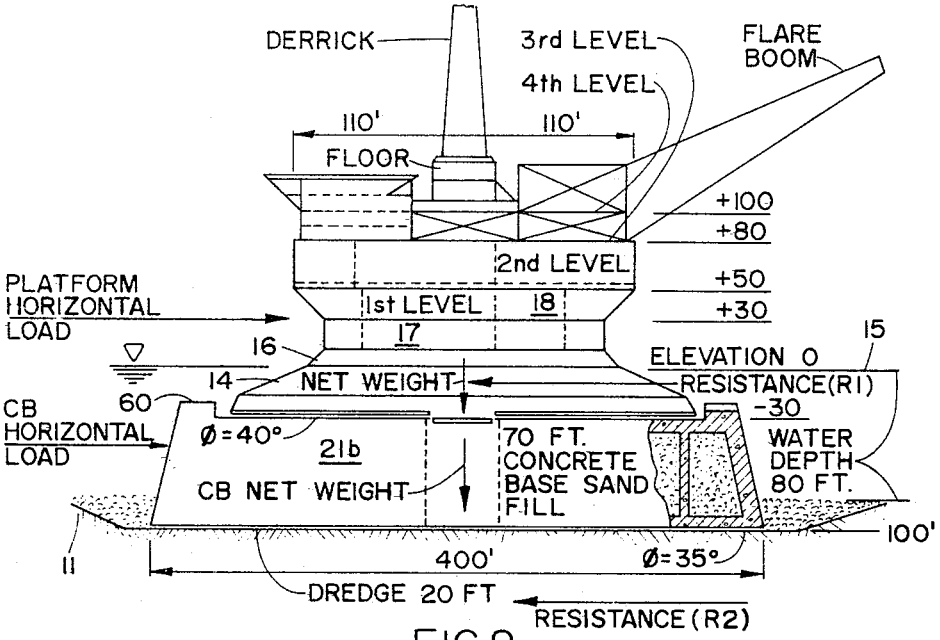
FIG. 2 is a partially sectioned plan view of a production platform and base member installed in about 100 ft of water.

The structures illustrated in FIGS. 1 and 2 are particularly adapted for use in the arctic environment, although they would provide great utility in any shallow water irrespective of the climactic environment. In addition to providing great lateral resistance to ice sheets or ice floes, they also provide great lateral resistance with respect to waves 30 and 40 ft high which may be encountered in other seas or oceanic regions having a shallow water depth and wherein frequent storms are encountered.

As illustrated in FIG. 1, an exploration platform has been mounted on a 40 ft high concrete base in 50 ft of water. As illustrated in FIG. 2, a production platform has been mounted on a 70 ft concrete base in 100 ft of water. Both the exploration platform illustrated in FIG. 1, and the production platform illustrated in FIG. 2 define an hourglass profile along the ice and wave engaging surfaces thereof. As illustrated in FIG. 1, the exploration platform defines a massive base member 14 having a conically sloped surface 14*a* below the mean water level located at 15 and a second steeper cross-sectional profile 16 above the mean water plane level located at 15. In addition, a reduced cross-sectional diameter portion 17 is provided before the platform again widens outwardly at the first level as indicated by 18 to provide support means for the operating equipment used in the exploration platform.

As illustrated in FIG. 1, an ice sheet 19 has engaged the conical surface 14, and as the horizontal load generated by the ice sheet impinges against the massive base member 14, the horizontal compressive forces are deflected into vertical tensile forces by the sloping conical surface 14*a* below the mean water level defined at 15. Ice may be characterized as having a significant structural strength in the compressive mode, but as being relatively frangible and fracturable in the tensile mode. Thus, as the forces encountered by the ice sheet are transmitted to the vertical shear mode, the ice sheet is fragmented and broken away from the main ice sheet 19 in the form of blocks 20.

The arctic waters in which the present structures are intended to operate are covered with ice eight to ten months of the year, with the ice sheet reaching an average thickness of six to nine feet. Pressure ridges are formed when two separate sheets of ice move towards each other and collide by the over thrusting in crushing of the two interacting ice sheets. As illustrated in FIG. 1, a pressure ridge has been formed as the ice sheet encounters the modular arctic structure constructed in accordance with the present invention. At times the pressure ridges will grow so large as to contact the ocean floor. The pressure loads generated by these ice sheets, and the pressure loads generated by waves of up to 40 feet in height is discussed hereinbelow in greater detail.

In addition to the pressure generated by the continuous ice sheets which "creep" or move slowly in response to climactic conditions during the winter months, large ice flows are encountered during the summer months, ice floes having a mean depth of seven or eight feet and ranging in diameter from ½ mile to a mile may impact the structure at speeds of up to 1 or 2 ft/sec when mobilized by a strong wind. The kinetic energy carried by an ice floe of this magnitude is significant and requires a massive base structure, together with the sloping hourglass configuration defined in FIGS. 1 and 2 to withstand the horizontal loads impinging upon the exploration or production platforms.

Referring to FIGS. 1 and 2, two structures have been illustrated, with two separate types of ballast. In FIG. 1, there is shown a water ballast, while in FIG. 2 there is shown sand fill ballast. A combination of water and sand could also be used to provide the gravity mass necessary to secure the base to the ocean floor. In some instances in which the ocean floor is of a particularly silty nature, it is desirable to remove the silt to a firm base, and to backfill the cavity with sand to the desired operating level prior to installation of the concrete base.

As contemplated by the present invention, the base units are constructed of concrete, and are embedded in the sea floor so that any horizontal loads transmitted to the base structure are dissipated by shear forces at the concrete soil interface through the classical gravity structure mode. It is contemplated that a friction angle of at least 35° can be achieved by preliminary dredging and overlaying the ocean floor with a sand layer prior to the installation of the concrete base. In addition, if the ocean floor at the desired site was constituted of a significant clay component, it may be desirable to deposit a layer of sand over the clay before installation to the concrete base inasmuch as the clay would tend to adhere to the undersurface of the structure, and possibly increase the effective weight of the structure to the point so that refloating and movement of the base at some future date could prove to be impossible.

A summary of the horizontal loads impinging upon the structure is presented in the following tables wherein Table 1 is representative of the ice load conditions and wave loading conditions for an exploratory platform with a 40 ft concrete base and a 70 ft concrete base. Table II is representative of the horizontal load impinging upon a production platform placed on both the 40 ft concrete base and the 70 ft concrete base.

TABLE I

| EXPLORATION PLATFORM | Horizontal Load (kips) | Net Weight (kips) | Lateral Resistance (kips) |
|---|---|---|---|
| Ice Load Condition | | | |
| Exploration Platform (Minimum Weight) | 40,000 | 75,600 | 63,400 (R1) |
| Exploration Platform (Maximum Weight) | 40,000 | 93,600 | 78,500 (R1) |
| Exploration Platform + 40 ft CB | 40,000 | 182,600 | 127,900 (R2) |
| Exploration Platform + 70 ft CB | 45,000 | 267,600 | 187,400 (R2) |
| 30 ft Wave Load Condition | | | |
| Exploration Platform (Minimum Weight) | 6,300 | 64,800 | 54,400 (R1) |
| Exploration Platform (Maximum Weight) | 6,300 | 82,800 | 69,500 (R1) |
| Exploration Platform + 40 ft CB | 9,600 | 161,400 | 113,000 (R2) |
| Exploration Platform + 70 ft CB | 18,700 | 242,000 | 169,500 (R2) |

TABLE II

| PRODUCTION PLATFORM | Horizontal Load (kips) | Net Weight (kips) | Lateral Resistance (kips) |
|---|---|---|---|
| Ice Load Condition | | | |
| Production Platform (Minimum Weight) | 78,000 | 106,400 | 89,300 (R1) |
| Production Platform (Maximum Weight) | 78,000 | 127,600 | 107,100 (R1) |
| Production Platform – 40 ft CB | 67,000 | 339,400 | 237,000 (R2) |
| Production Platform – 70 ft CB | 170,000 | 541,200 | 379,000 (R2) |
| Wave Load Condition | | | |
| Production Platform (Minimum Weight) | 8,400 | 92,000 | 77,200 (R1) |
| Production Platform (Maximum Weight) | 8,400 | 113,200 | 95,000 (R1) |
| Production Platform – 40 ft CB | 12,800 | 311,100 | 217,800 (R2) |
| Production Platform – 70 ft CB | 24,900 | 507,000 | 355,000 (R2) |

The horizontal loads, the net weight and resistance R1 and R2 are illustrated in FIG. 2. These tables are set forth by way of examples of values that were calculated for two separate sizes of base members, a typical exploration structure, and a typical production platform structure. In computing these numbers, the design water depth ranged from 20 to 100 feet. The sea state was assumed to have a maximum wave height of 40 feet, a wave period of 10 seconds, and a sustained wind speed of 120 knots. The cummulative tide, encompassing both astronomical tide and storm tide, was assumed to be 10 feet, and the surface current was assumed to be 4 knots.

In computing the ice loading, the maximum sheet ice thickness was considered to be 7 ft, the multiyear ice thickness was considered to be 15 ft, and the multiyear ridge height was assumed to be water depth. The angle of friction for soil cohesion was assumed to be 35° between the concrete base and the ocean bottom and 40° between the exploration or production platform and the concrete base.

As was previously indicated, the modular arctic systems are intended to be moved by floatation from the side of origin to the installation site. The ballasting of the concrete base and of the massive support base for the platform provide the necessary mass to resist the lateral shear loads imposed thereon by the ice sheets. By way of example, the total weight of the 40 foot base illustrated as 21*a* in FIG. 1 was computed to be 65,600 ST or 131,200 kips. The displacement of the 40 foot concrete base was 130,800 ST or 261,600 kips. The draft, computed for the above weight and displacement, was 22 feet.

Figure 6:
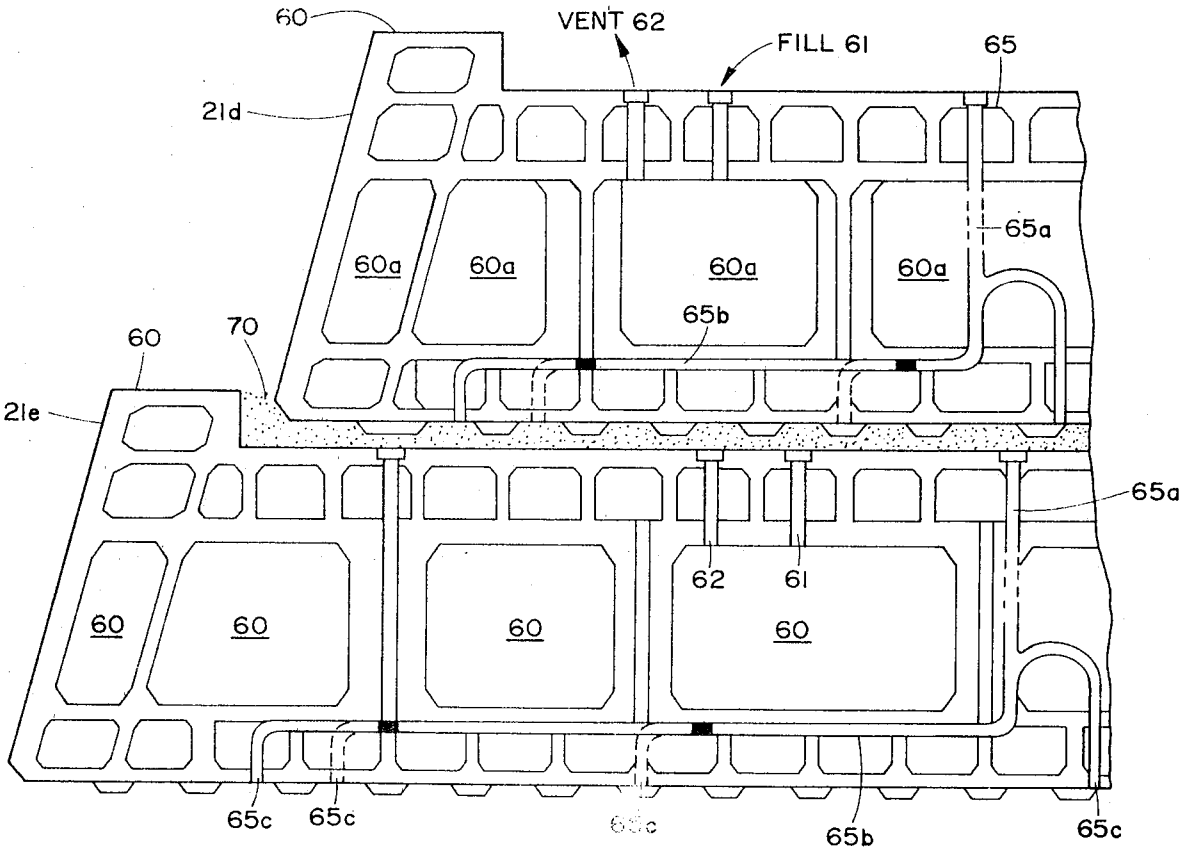
FIG. 6 is a sectional view illustrating a a modular base member and arrangement for filling the base member with a suitable ballast.

The concrete base illustrated at 21*b* in FIG. 2 was computed to be 145,100 ST or 290,100 kips, its displacement was 253,600 ST or 507,200 kips and its draft transit was 37 feet. Inasmuch as many portions of the shallow waters of the arctic ocean and bays in which the device is intended to be used may prohibit the use of a device with a 37 foot draft, it is contemplated by the invention that the concrete base may also be constructed in modular form as illustrated in FIG. 6 and towed to the exploration or production site for assembly in situ.

As illustrated in FIGS. 1 and 2, the exploration and production platforms have a substantial proportion of their structure above the mean water level. Nevertheless, the major portion of the weight and displacement, when installed, is below the mean water level. The weight of the exploration platform illustrated in FIG. 1 was computed to be 51,400 kips, or 25,700 ST. Of this, 39,200 kips was located in the ice shield the double bottom, and the bulkheads of the hull structure which are at or below the mean water level for the structure. Thus, 76% of the total weight, before ballasting, is located below the mean water line for the hull. In transit, the displacement of the exploration hull structure will draw a 17 foot draft.

The production platform, which is somewhat larger than the exploration platform was calculated to have a weight of 42,100 ST or 84,200 kips. Of this, 38% of the weight was involved in the production platform, equipment, and quarters for the crew, and the remaining 62% in the hull structure and ice shield. The production platform had a total transit displacement which drew a 23 foot draft before ballasting.

It should be understood that once the structures are towed to their on site location, and ballasted into position, a substantial amount of gravity mass is added not only by the ballasting, but by the liquids stored in the platforms. Thus the minimum weight for the production platform was calculated to be 42,100 ST while the total weight with liquids was computed to be 50,300 ST. The production platform is capable of holding 54,400 ST of ballast, and when positioned on a concrete base extending to 30 feet below the mean water level, the displacement is 51,500 ST. Thus, the total minimum weight of the production platform is 53,200 ST or 106,400 kips. Its maximum weight, when filled with producing liquids, drilling liquids and consumables, drill water and fuel oil totals 60,900 ST plus 54,400 ST of ballast. The displacement of 51,500 remains the same, or total maximum weight of 63,800 ST or 127,600 kips.

The total gravity mass of the modular system is calculated in the following two tabular examples as being representative of the total mass generated by the base member, the structural member, and the respective ballasting added to each member with a compensating displacement lift subtracted therefrom. Table III is for the structure illustrated in FIG. 1, while Table IV is for the structure illustrated in FIG. 2.

TABLE III

| Net Founding Weights (ST) Exploration Platform + 40 ft Concrete Base | |
|---|---|
| Concrete Structure | 61,100 |
| Appurtenances | 3,500 |
| Installation and Tow Appurtenances | 1,000 |
| Total Transit | 65,600 ST |
| Draft: 22 ft | |
| Maximum Weight: | |
| Total Transit Displacement | 65,600 |
| Maximum Weight Exploration SGS | 46,800 |
| Interface System (Sand) | 9,000 |
| Ballast | 105,200 |
| Total Maximum | 226,600 |
| Displacement | (130,800) |
| Maximum Net Weight | 95,800 ST |
| Minimum Net Weight | 86,800 ST |

TABLE IV

| Net Founding Weights (ST) Production Platform + 70 ft Concrete Base | |
|---|---|
| Concrete Structure | 139,900 |
| Appurtenances | 4,500 |
| Installation and Tow Appurtenances | 1,000 |
| Total Transit | 145,400 ST |
| Draft: 37 ft | |

TABLE IV-continued

| Net Founding Weights (ST) Production Platform + 70 ft Concrete Base | |
|---|---|
| Maximum Weight: | |
| Total Transit Displacement (70 ft CB) | 145,400 |
| Maximum Net Founding Weight Production SGS | 63,800 |
| Interface System (Sand) | 9,000 |
| Ballast | 311,300 |
| Total Maximum | 529,100 |
| Displacement (70 ft CB) | (253,600) |
| Maximum Net Weight | 275,900 ST |
| Minimum Net Weight | 265,300 ST |

As can be ascertained from the foregoing values, the computed weights and displacements values for each of the components of the modular arctic system provide floatable bases and platforms which may be ballasted into position over an exploration or development site.

The ballasting of the concrete base into position is difficult inasmuch as the concrete base loses its water plane once it slips beneath the surface of the ocean. In addition, it is impractical to maintain the center of buoyancy at a significant distance above the center of gravity for the concrete vessel. The combined effects of the loss of water plane and the differential between the center of buoyancy and the center of gravity would cause the vessel to submerge out of control once it drops beneath the water surface.

Figure 3:
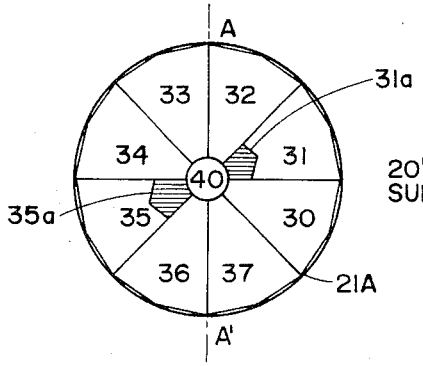
FIG. 3 is a diagrammatic plan view of the base member of the present invention.
Figure 4:
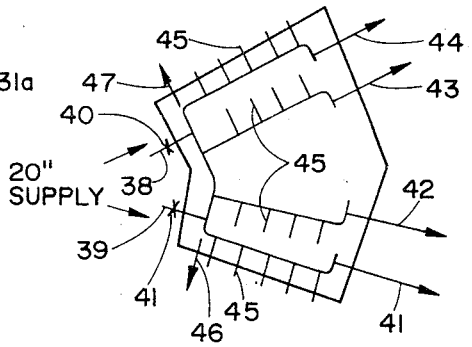
FIG. 4 is a diagrammatic view of the ballasting means used to initially lower the base member into its desired location.

FIGS. 3 to 5 illustrate a novel method for submerging a concrete base of the present invention while maintaining a level keel with respect to the ocean floor.

As illustrated in FIG. 3, the concrete base structure is formed of modular segments 31–37, wherein two of these segments 31 and 35 include valve rooms which provide the initial ballasting of the vessel. A schematic of the one of the valve rooms is illustrated in FIG. 4. Two 20-inch supply mains 38 and 39 open into the moon pool 40 formed in the center of the concrete base. Valve members 40 and 41 provide flooding of the various compartments within the concrete base member by headers 41–44 and a plurality of lateral feed conduits generally identified by the numeral 45. In addition, circumferential headers 46 and 47 are provided to route the incoming sea water to each of the segments in the concrete device. For example, the valve room 31*a* illustrated in FIG. 3 is adapted to control ballasting for segments 30, 31, 32 and 33, while the valve room 35*a* illustrated in segment 35 is adapted to control the flooding of the chambers and compartments in segments 34, 35, 36 and 37.

The above is meant to be merely representative, and it is to be understood by one skilled in the art that various configurations of the concrete base member would result in various sizes and shapes of compartments in order to achieve maximum structural integrity for the structure. As such, the piping illustrated in FIGS. 3 and 4 is meant to be a representation, of one possible arrangement of ballasting a base member.

Figure 5A:
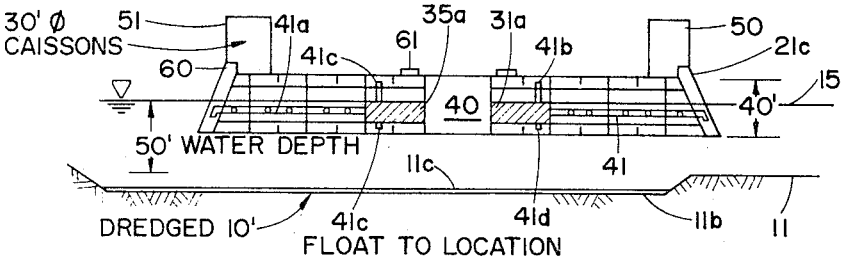
FIG. 5*a* is a sectional plan view of the first step in the novel method of ballasting the base member into its desired location.

The novel method for submerging the concrete base is illustrated in FIGS. 5*a*–5*d*. As illustrated in FIG. 5*a*, a 40 foot concrete base member 21*c* is floated to its desired location. A plurality of buoyancy caissons represented generally in FIGS. 5*a*–5*d* as 50 and 51 are attached to the upper outer periphery of the concrete base member. For the 40 foot base illustrated in FIG. 5*a*, six 30-foot diameter caissons are attached to the upper outer periphery of concrete base member 21*c*. A cavity 11*b* is dredged in the ocean floor and provided with a relatively thin sand layer 11*c*. The sand layer is used to provide final adjustment of the depth of the cavity below the mean water plane 15. While the designs of the exploration and production vessels illustrated in FIGS. 1, 2 could be altered to any specific dimension, the chosen design dimension provides that the top of the base support member 21*c* should be 30 feet below mean water level 15 when the base member is fully submerged and in place. The sand layer 11*c* is used to even out any irregularities in the dredged cavity, and to provide a consistent and predictable lateral angle of cohesion for the concrete base member 21*c*.

Figure 5B:
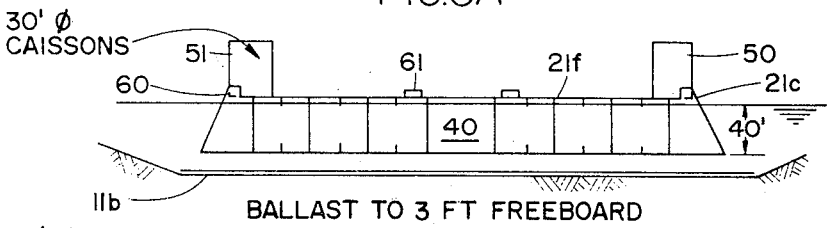
FIG. 5*b* illustrates the second step in the novel method of ballasting the base member into its desired location.
Figure 5C:
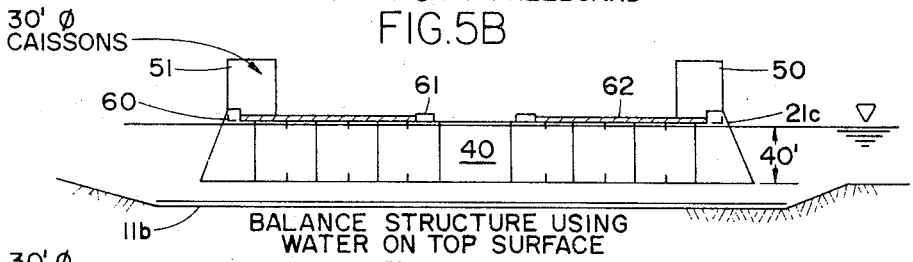
FIG. 5*c* illustrates the third step in the novel method of ballasting the base member into its desired location.
Figure 5D:
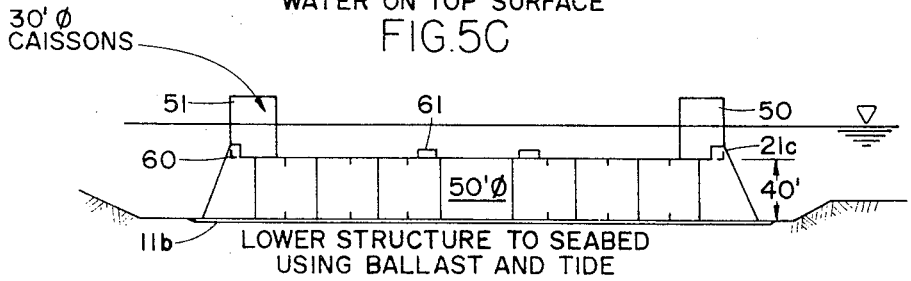
FIG. 5*d* illustrates the base member installed in its final position.

For purposes of clarity, valve rooms 31*a* and 35*a* illustrated in FIGS. 3 and 5*a* have been omitted from FIGS. 5*b*–5*d*, as have the supply conduits and headers 41 and 41*a* illustrated in FIG. 5*a*. In addition FIG. 5*a* illustrates vertical risers 41*b*–41*e* which are provided for flooding the upper and lower compartments of the multi-compartmented concrete base member.

After the cavity has been prepared, and the base member 21*c* floated to the location illustrated in FIG. 5*b*, the concrete base member is ballasted to approximately 3 feet of freeboard. This is done by opening valves 40 and 41 in valve room 31 and corresponding valves in valve room 35*a* (not shown). As illustrated in FIGS. 1, 2, 5, 6 and 7, the concrete base member defines an upstanding annular rim 60 which extends around the perimeter of the concrete base member. As will be hereinafter illustrated with respect to FIG. 7, the elevation of the upstanding aim or parapet wall may vary depending on its location on the concrete base. However, for the base member illustrated in FIGS. 5*a*–5*d* the upstanding rim or parapet wall extends from 5 to 8 foot above the upper surface 21*f* of the concrete base member 21*c*. In addition, an interior annular rim 61 is installed around moon pool 40 by means of sand bags or other removable water-impervious members.

Once the concrete base member is positioned and ballasted to approximately 3 foot of freeboard, sea water is pumped into the upper annular space defined between the parapet wall 60 and inner temporary rim 61 to define an upper annular lake 62. The lake on top of the surface of the base is used as a balancing device to level the structure. The procedure is sensitive enough to accurately bring the center of gravity to normal alignment with the plane of the concrete base, and directly in line with the center of buoyancy. Once the lake levels the structure as illustrated in FIG. 5*c*, the concrete base can be submerged using the gravity ballast method by reopening valves 40 and 41 in valve room 31*a*, and the corresponding valves (not shown) in valve room 35*a*. As the concrete parapet is submerged, the six caissons are used to maintain a sufficient medacentric height above the mean water plane 15 to prevent any tipping or tilting as the base descends the final 10 to 20 feet to the cavity 11*b*. It should be noted that when the concrete base 21*c* is installed as illustrated in FIG. 5*d*, the ballasting compartments are filled with sea water, the caissons are then partially flooded and removed prior to the installation of the exploration or drilling rig. In actual use, the base member may be installed as much as a year prior to the shipment and delivery of the exploration or development platform.

As illustrated in FIGS. 3 and 6 the concrete base may be formed of a modular construction. The modular construction may be both vertical (FIG. 3) and horizontal (FIG. 6). The diameter of the concrete base member, for large installations may approach 400 feet. When the concrete base is that large, it may be divided as illustrated in FIG. 3 along axis a–a′ constructed in two halves, port and starboard, to limit the size of the dry or graving dock required. While it would be possible to construct a graving dock to accommodate a 400 foot diameter structure, it is considered more economical to build concrete bases in halves and mate them together in a protected location. The halves will be mated while they are floating by using prestress steel that is added to the first interior bulkheads. In addition, where water passages will not permit the passage of a 70 foot high concrete base with a 37 foot transit draft, it may be desirable to fabricate the concrete base in vertical modular components as illustrated in FIG. 6.

The concrete base member illustrated in FIG. 6 is formed of two vertical components 21*d* and 21*e* which are stacked above one another. In addition, FIG. 6 illustrates the novel method of filling the ballast tanks generally indicated as 60 and 60*a* with sand or a mixture of sea water and sand in a slurry form. As schematically illustrated in FIG. 6, each of the compartments is equipped with a fill opening 61 and a vent opening 62. The fill and vent pipes 61 and 62 are a series of short run pipe tubes that penetrate the top of the slab of the concrete base and communicate with the ballast chambers 60 and 60*a*. The top of each spout has a flange to which a flexible pipe from pumps or sand hoppers on a service barge can be attached. Two pipe spouts 61 and 62 are provided for each compartment so that a more level top surface of said fill can be attained, and so that water can escape as fill is placed in the other spout. While vent and fill openings 61 and 62 have been illustrated for ballast chambers 60 and 60*a* in FIG. 6 it is to be understood each of the ballast chambers 60 and 60*a* contain separate and distinct fill and vent lines. The fill and vent tubes are intended to be a representation of one type of filling and venting method that could be employed to fill the cavity 60 and 60*a* with a sand or sand/seawater slurry ballast. The fill pipes 61 may be as much as 24 inches in diameter to provide for rapid and efficient ballasting of the compartments 60 and 60*a* with water or sand.

Each of the concrete base members 21*e* and 21*d* also includes a slurry grouting system 65 which includes an upstanding vertical fill tube 65*a* and a plurality of horizontal headers indicated by 65*b* that terminate in a plurality of downwardly extending openings generally indicated at 65*c*. As illustrated in FIG. 6, the downwardly extending grout tubes may be as much as 24 inches in diameter, with the radially outwardly extending headers 65 being 12 to 14 inches in diameter. Each of the downwardly extending spouts 65*c* is approximately 6 inches in diameter.

The slurry grouting system below the base is composed of a system of 6 inch pipes which distribute sand slurry to subdivided 2,500 sq/ft areas under the concrete base. Sand builds up in one area and works its way back along the internal piping until the first 2,500 sq/ft area is filled. The slurry flow will then allow a second consecutive area to be filled and so on. The slurry pipe network can also be used for a water jet before lift off when it is 5 desired to refloat the base. Refloating the base is accomplished by installing air hoses from barge mounted air compressors to the fill tube openings 61. A vertical water vent extending downwardly to the floor of compartments 60 and 60*a* is then installed in the vent openings 62. The air pressure generated by the compressors will then deballast the compartments. The grouting system illustrated in FIG. 6 is used when the concrete base member 21*e* is installed on the ocean floor without the sand layer 11*c* previously illustrated in FIG. 5*a*. In addition, when a pair of modular units are stacked vertically, a sand slurry may be pumped between the concrete base units as illustrated by sand pillow 70 in FIG. 6. Sand pillow 70 enables the selection of a sand material having a shear angle of at least 40° to maximize the gravity shear resistance imparted from base member 21*e* to the secondary member 21*d*.

Figure 7:
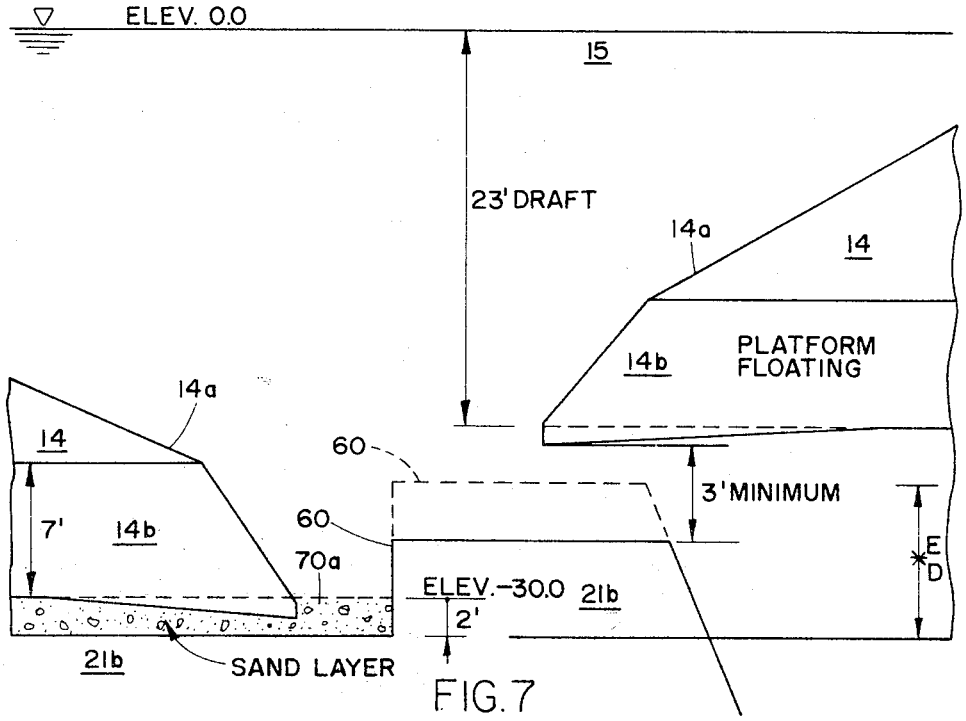
FIG. 7 is a partial plan view of the method of floating a production platform over a base member according to the method of the present invention.

After installation of the base member, the exploration or drilling platform illustrated in FIGS. 1 and 2 are floated into position as illustrated in FIG. 7. When installating the modular system the relatively shallow water, the respective draft of the platform to be used and the height of the concrete base must be very carefully calculated to ensure that the upper surface of the concrete base member 21*b* is 30 feet below the mean water level. Inasmuch as the production platform is designed with a 23-foot draft, a 7-foot clearance will be maintained between the installed height, and the draft drawn by the floating platform. The upstanding rim or parapet wall 60 illustrated in FIG. 7 is illustrated as having two separate heights. The seaward parapet wall is 8 foot high, while the shoreward parapet wall is 5 foot high. The floating platform is brought in from the shoreward side of the concrete base structure to provide a 3-foot minimum clearance between the draft of the floating platform and the parapet wall on the shoreward side of the concrete base member 21*b*. As illustrated in FIG. 7, the lower tanks 14*b* of the platform clear the shoreward parapet by 3 foot as the platform is positioned over the concrete base member. The ice shield also covers the lower tanks 14*b* of the production platform.

As was previously illustrated with respect to FIG. 6, a sand layer or sand pillow 70*a* is provided between the upper surface of the concrete base member and a lower surface 14*b* of the production platform. Again, the sand layer 70*a* is used to provide a high angle of cohesion between the steel surface of the production platform, and the concrete base member 21*b*. The specified 40° angle results in a significant safety factor of 1.59 between the platform and the concrete base. A 30° angle would be equivalent to a friction factor of 0.58, well above the factor of 0.30 that could be expected from a pure steel-soil interface. The 30° angle of friction characterizes a poorly graded said or silt with a relative density less than 50%. The sand layer 70 and 70*a* is provided from a service barge mounted above the assembly area to provide a sand grout having a 40° angle of friction to maximize the shear factors between these structures.

Both the exploration and production platform contain ballasting systems for lowering the platform into place once it has been positioned. While it is essential that the system for the exploration platform provide for deballasting, the production platform need not contain a deballasting system if its production life is intended to be approximately equal to the service life of the production site.

The platform structures are submerged during installation from their 17 or 23-foot draft to their founded condition in 30 foot of water as illustrated in FIGS. 1 and 2. The ballast systems are designed with contingency systems and backup system. The ballast systems are also available for refloatation at any time to enable the structure to be relocated in the event that adverse ice conditions are encountered which exceed the design capabilities of the platform.

Figure 8:
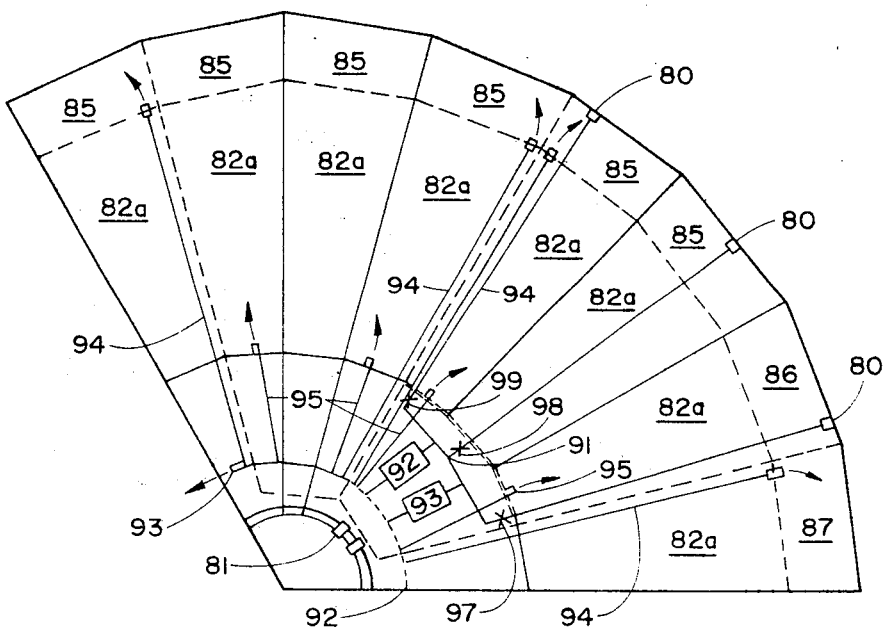
FIG. 8 is a diagrammatic plan view of a portion of the exploration or drilling platform illustrating the ballasting arrangement used for ballasting a platform into position.
Figure 9:
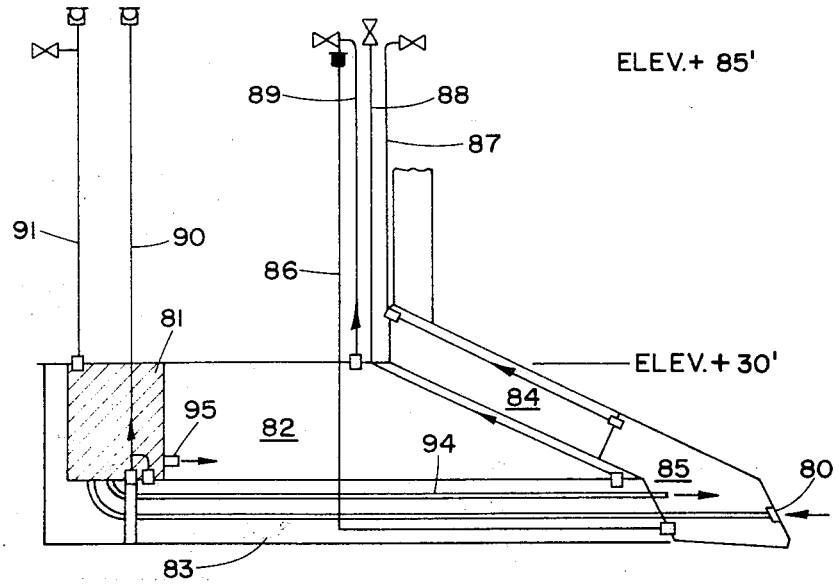
FIG. 9 is a diagrammatic elevation view of the lower portion of an exploration or production platform illustrating the ballasting and venting arrangement therefore.

Pump or valve flooding is used to provide a controlled descent and landing as illustrated in FIGS. 8 and 9. Water is pumped onboard through sea chest 80 on the outer periphery of the ice shield at the level of the double bottom within 7-feet of the bottom of the hull. Water is distributed via a valve manifold system in a valve and pump room 81 as illustrated in FIGS. 8 and 9. Ballasting of the platforms may be accomplished by valving sea water into the ballast tanks 82, 83 and 84 and 85 as illustrated in FIG. 9, and as illustrated at 82*a* and 85*a* in FIG. 8. The ballast tanks 82–85 are vented to 85 feet above the surface by means of vent lines 86–90. Alternately, pumps 92 and 93 illustrated in FIG. 8 may be used for controlled descent by pumping the incoming sea water from sea chest 80 into a series of manifolds generally indicated by 92 and 93 and a plurality of radially outwardly extending headers generally indicated at 94, 95.

The outwardly extending radial headers 94 and 95 are also used for deballasting when it is desired to refloat the platform. Pumps 92 and 93 then draw water from the ballast tanks 82–85 and eject it upwardly via discharge line 91 to an elevation 85 foot above sea level. This is done to prevent clogging of the outlets due to surface ice or ice ridges that may have built up on the surface of the ice shield. The reversal of the pumping action by pumps 92 and 93 may be accomplished by pipe manifolding, or by closing valves 97–99 and reversing the action of the pumps to pump the seawater from the ballast tanks through conduit 91.

The vent system illustrated at 86–90 is designed to backup the ballasting system to provide yet another way to ballast and deballast the ballast tanks. The nominal purpose, however, of the vent system is to vent the tanks and to provide sounding tubes for a level indicator system. The most efficient network of vent piping provides vertical runs directly to the weather deck from each compartment. Manifolds are used to minimize the number of termination areas. Groups of vent pipes therefore share a common control area. The vent pipes are also terminated at an elevation of 85 feet above the mean water plane to prevent clogging with ice at the outlet, to provide maintenance convenience, and to maintain hull integrity to that elevation. Each compartment has more than one vent outlet placed at the extreme end of the tanks so the pressure can be released in the case the outlets are blocked because of the inclination of the structure, because of icing, or because of some other obstruction.

It is apparent that the actual manifolding and piping configuration are dependent upon the tank and bulkhead structures actually employed in the construction of the platform. Inasmuch as these will vary depending upon the size and nature of the platform, the piping diagram set forth in FIG. 8 and FIG. 9 is meant to be a representation of one layout. Many other piping layouts could be used to accomplish the same function. It should be noted that pipe diameters are relatively large with 18 inch manifolds extending outwardly to the seachest openings 80, and 12 inch distribution headers being used to flood the various ballast compartments 82–85. The vent lines 86–90 are sized at 8 inches to prevent the build up of back pressure during the filling of the ballast tanks 82–85. The design capacity of pumps 92 and 93 is 40,000 gallons per minute and two such pump rooms are contemplated for each of the platforms. Thus, the design of the system enables complete deballasting of the platform within 12 hours.

It should be noted that the steel platform structures and the concrete base structures are framed with double walls around the circumference. This means that at least two bulkheads must be penetrated by any ice floes before significant structural damage will occur. The highest stresses occur when the bulkheads are subjected to a large vertical load at their intersection with the outer ice shield. This is the point at which the large lateral loads are applied by the ice and transmitted to vertical shear forces by the slanted surface of ice shield 14*a*. The design ice pressure for ice shield 14 is 1,200 lbs/in$^2$.

Figure 10:
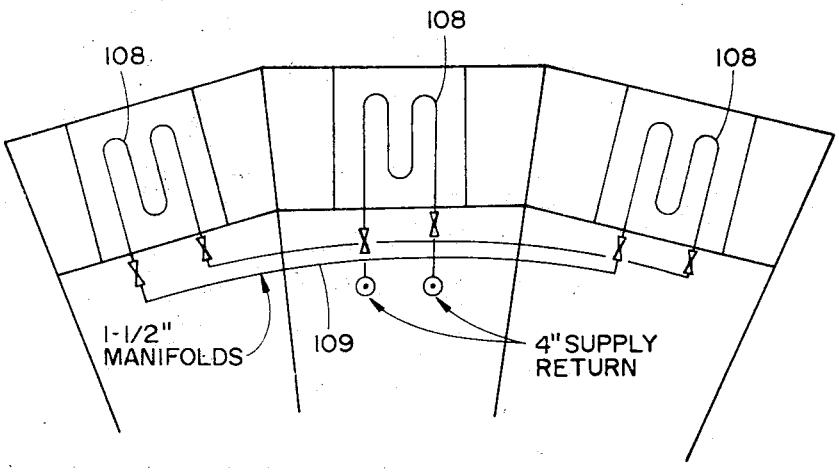
FIG. 10 is a diagrammatic view of a heating arrangement used to prevent the ballast from freezing and to prevent adfreeze of the ice sheet to the platform hull.
Figure 11:
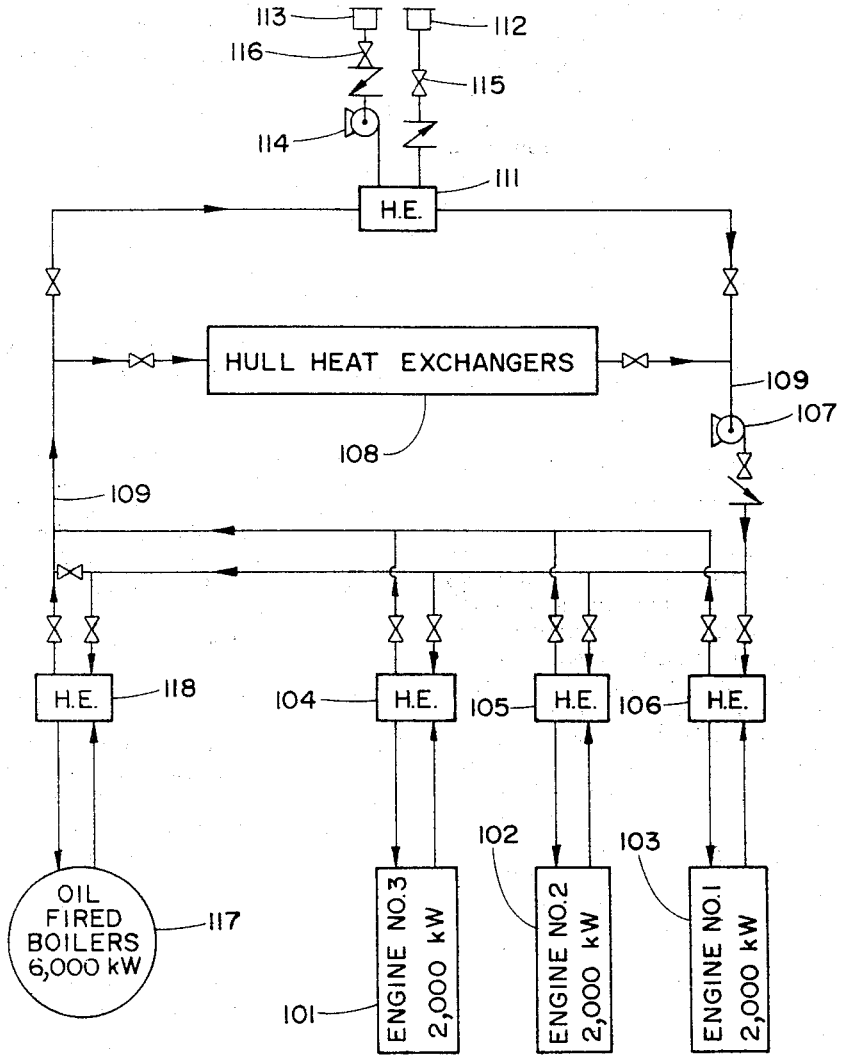
FIG. 11 is a diagrammatic view of the heat scavenger system used to supply the heating arrangement illustrated in FIG. 10.

The modular arctic structure also includes a heating arrangement as illustrated in FIGS. 10 and 11. The hull heating is principally intended to prevent freezing of the ballast water. It is also intended to prevent ice sheets from freezing to the structure and inducing extreme loads when the ice begins to move because of environmental conditions.

The waste heat from the prime mover engines 101, 102, 103 is dissipated to the outer hull as illustrated in FIG. 10 by means of heat exchangers 104, 105 and 106 which are continually pumped by means of pump 107 to the hull heat exchangers generally indicated by 108 in FIGS. 9 and 10. Manifold piping generally indicated 109 provides a continuous loop between the heat exchanger 104, 105 and 106 and the hull heat exchangers 108. In addition, a supplemental heat exchanger 111 is provided to dissipate heat to the arctic sea through sea chests 112 and 113 by means of pump 114. If the heat load generated by the prime mover engines 101–103 exceeds the demand of the hull heat exchangers 108, the valve members 115 and 116 are opened to allow the excess heat to be dissipated into the arctic ocean. In the event the engines 101–103 are not dissipating enough heat, oil-fired boilers generally indicated at 117 can be used to provide supplemental heat through heat exchanger 118.

An economical arrangement results if the hull is divided into eight 45° segments, with a heating coil type network as illustrated in FIG. 10 being provided for each segment. Most of the heat is lost through the steel plates above the water surface. The air zone dissipates 520 btu per hour per square foot while the ice sheet dissipates 44 btu per hour per square foot. The water zone dissipates only 4 btu per hour per square foot. These values are based on internal bath water temperatures of 50°–60° F. Based on these figures, each 45° segment of the hull structure would normally dissipate 1.4 million btu per hour. The three engines 101–103 at full capacity would be able to supply as waste heat 18.9 million btu per hour. Thus each segment of the hull could be heated if desired, although it would appear that only those segments oriented towards the advancing ice flow would need to be heated.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A floatable and reusable modular offshore oil and gas production or exploration platform system, said system being particularly adapted for arctic environments, said system comprising in combination:

(a) a floatable base member towable to an exploration or production site, said base member including;
  i. ballasting means for lowering the base member below the water plane to an offshore ocean floor;
  ii. said floatable base member defining a first massive base that extends upwardly to a predetermined distance below the main water plane for supporting said offshore exploration or production platform, said first massive base providing lateral load resistance therefor by gravity engagement with the ocean floor; and
  iii. an upwardly extending annular rim;

(b) a plurality of temporary buoyancy caissons which are attached to said first base member before ballasting;

(c) means for filling the annular space defined by said rim with sea water to provide an interior lake on the top surface of said base, said interior lake and said buoyancy caissons balancing said base member as it is ballasted below the water plane;

(d) an offshore exploration or production platform, said platform member towable to said exploration or production site, said platform member comprising;
  i. ballasting means for lowering the platform onto said first base member;
  ii. a steel gravity structure having a conical sloping surface at the mean water plane defined by the height of said first base member and said platform, said sloping surface forming an ice shield upon use in an arctic environment; and (e) said base member and said platform including at least one vertically extending aperture for oil and gas exploration or production, whereby the platform and the first base member are separately deballastable at the end of the exploration or production service and refloatable to a new exploration or production site.

2. A modular offshore oil or gas exploration and production platform system as claimed in claim 1, comprises a high-shear gripping means between said platform and said first base member, said gripping means being confined by said annular rim.

3. A modular offshore oil and gas exploration or production platform system as claimed in claim 1, wherein said high shear gripping means comprises a sandbed formed within said rim.

4. A modular offshore oil and gas exploration and production platform system as claimed in claim 1, wherein said first massive base member is ballasted to a predredged ocean floor, said base member extending upwardly to a predetermined distance below the main water plane.

5. A modular offshore oil and gas exploration and production platform system as claimed in claim 4, wherein said predredged ocean floor is layered with sand before said base member is ballasted into position.

6. A modular offshore oil and gas exploration and production platform system as claimed in claim 4, wherein said first base member includes means for pumping a sand slurry into a plurality of annular cavities formed between the ocean bottom and said base member.

7. A modular offshore oil and gas exploration and production platform system as claimed in claim 1, wherein said first base member has an annular configuration with an external sloping side.

8. A modular offshore oil and gas exploration and production platform system as claimed in claim 1, wherein said first base member is formed of modular components and assembled on site before ballasting.

9. A modular offshore oil and gas exploration and production platform system as claimed in claim 1, wherein said first base member defines a plurality of compartments for receiving sand, water, or a mixture thereof as ballast generate lateral load stability.

10. A modular offshore oil and gas exploration and production platform system as claimed in claim 1, wherein said base member is formed of prestressed reinforced concrete.

11. A modular offshore oil and gas exploration and production platform system as claimed in claim 1, wherein said platform has an hourglass profile with a massive gravity base, said massive gravity base cooperating with said first base member to impart lateral load stability to the system.

12. A modular offshore oil and gas exploration and production platform system as claimed in claim 1, wherein said platform comprises heat exchanger means adjacent the outer walls of said conical portions of said platform to prevent freezing of the ballast tanks and adfreezing of ocean water to said platform.

13. A modular offshore oil and gas exploration and production platform system as claimed in claim 12, wherein said heat exchanger means is connected to a scavenger system utilizing heat generated by at least one work engine mounted within said platform.

14. A method of installing a floatable and reusable offshore oil and gas exploration or production platform, said method comprising:

(a) dredging a cavity in the ocean floor, said cavity being dredged to a predetermined level below the mean water plane of the ocean;

(b) floating a massive base member to said cavity and ballasting said base member into said cavity, said base member extending upwardly to a predetermined level below the mean water plane;

(c) attaching a plurality of buoyancy caissons to the upper surface of said base member;

(d) pumping sea water into an annular cavity defined by the upper surface of said base member to form an interior lake on the upper surface thereof;

(e) filling a plurality of internal buoyancy chambers defined within said base member with water, sand, or a mixture thereof to ballast the base member below the water plane into said cavity; and (f) floating said oil and gas exploration or production platform over said base member, and ballasting said platform into gravity engagement with said base member, whereby the platform and the base member are separately reballastable at the end of the exploration or production service period and refloatable to a new exploration or production site.

15. A method as claimed in claim 14, which includes the step of backfilling said ocean floor cavity with sand before said base member is ballasted into position.

16. A method as claimed in claim 14, which includes the step of pumping a sand slurry into a plurality of cavities formed between the base and the ocean floor.

17. A method as claimed in claim 14, which includes the step of forming a sandbed on the upper surface of said base member before said platform is ballasted into position.

18. A method as claimed in claim 14, which includes the step of assembling said first base member from a plurality of modular components.

* * * * *